US005787398A

United States Patent [19]

Lowry

[11] Patent Number: 5,787,398

[45] Date of Patent: Jul. 28, 1998

[54] APPARATUS FOR SYNTHESIZING SPEECH BY VARYING PITCH

[75] Inventor: Andrew Lowry, Ipswich, England

[73] Assignee: British Telecommunications PLC, London, England

[21] Appl. No.: 702,933

[22] Filed: Aug. 26, 1996

Related U.S. Application Data

[63] Continuation of PCT/GB95/00588 Mar. 17, 1995, published as WO95/26024 Sep. 28, 1995 and a continuation-in-part of Ser. No. 241,893, May 13, 1994.

[30] Foreign Application Priority Data

Mar. 18, 1994 [EP] European Pat. Off. ..... 94301953

[51] Int. Cl.[6] ..... G10L 9/00

[52] U.S. Cl. ..... 704/268

[58] Field of Search ..... 704/262, 263, 704/264, 265, 266, 267, 268

[56] References Cited

U.S. PATENT DOCUMENTS

| | | | |
|---|---|---|---|
| 4,624,012 | 11/1986 | Lin et al. | 704/261 |
| 5,067,158 | 11/1991 | Arjmand | 381/51 |
| 5,163,110 | 11/1992 | Arthur et al. | 704/200 |
| 5,327,518 | 7/1994 | George et al. | 704/211 |
| 5,400,434 | 3/1995 | Pearson | 704/264 |
| 5,524,172 | 6/1996 | Hamon | 704/268 |

FOREIGN PATENT DOCUMENTS

WO 90/03027 3/1990 WIPO .

*Primary Examiner*—David R. Hudspeth
*Assistant Examiner*—Susan Wieland
*Attorney, Agent, or Firm*—Nixon & Vanderhye, PC

[57] ABSTRACT

The pitch of synthesized speech signals is varied by separating the speech signals into a spectral component and an excitation component. The latter is multiplied by a series of overlapping window functions synchronous, in the case of voiced speech, with pitch timing mark information corresponding at least approximately to instants of vocal excitation, to separate it into windowed speech segments which are added together again after the application of a controllable time-shift. The spectral and excitation components are then recombined. The multiplication employs at least two windows per pitch period, each having a duration of less than one pitch period. Alternatively each window has a duration of less than twice the pitch period between timing marks and is asymmetric about the timing mark.

21 Claims, 3 Drawing Sheets

P = PITHMARK
F = FRAME

APPARATUS FOR SYNTHESIZING SPEECH BY VARYING PITCH

CROSS-REFERENCE TO RELATED APPLICATION

This application is a continuation (under 35 USC §120/365) of copending PCT/GB95/00588 designating the U.S. and filed 17 Mar. 1995, published as WO95/26024 Sep. 28, 1995, as, in turn, a continuation-in-part (under 35 USC §120/365) of copending U.S. application Ser. No. 08/241,893 filed 13 May 1994.

FIELD OF THE INVENTION

The present invention is concerned with the automated generation of speech (for example from a coded text input). More particularly it concerns analysis-synthesis methods where the "synthetic" speech is generated from stored speech waveforms derived originally from a human speaker (as opposed to "synthesis by rule" systems). In order to produce natural-sounding speech it is necessary to produce, in the synthetic speech, the same kind of context-dependent (prosodic) variation of intonation that occurs in human speech. This invention presupposes the generation of prosodic information defining variations of pitch that are to be made, and addresses the problem of processing speech signals to achieve such pitch variation.

BACKGROUND OF THE INVENTION

One method for pitch adjustment is described in "Diphone Synthesis Using an Overlap-add Technique for Speech Waveforms Concatenation", F. J. Charpentier and M G Stella, Proc. Int. Conf. ASSP, IEEE, Tokyo, 1986, pp. 2015–2018. Sections of speech waveforms each representing a diphone are stored, along with pitchmarks which (for voiced speech) coincide in time with the greatest peak of each pitch period of the waveform and thus correspond roughly to the instant of glottal closure of the speaker; or are arbitrary for unvoiced speech.

A waveform portion to be used is divided into overlapping segments using a Hanning window having a length equal to three times the pitch period. A global spectral envelope is obtained for the waveform, and a short term spectral envelope obtained using a Discrete Fourier transform; a "source component" is obtained which is the short term spectrum divided by the spectral envelope. The source component then has its pitch modified by a linear interpolation process and it is then recombined with the envelope information. After preprocessing in this way the segments are concatenated by an overlap-add process to give a desired fundamental pitch.

Another proposal dispenses with the frequency-domain preprocessing and uses a Hanning window of twice the pitch period duration ("A Diphone Synthesis System based on Time-domain Prosodic Modification of Speech", C. Hamon, E Moulines and F. Charpentier, Int. Conf. ASSP, Glasgow, 1989, pp. 238–241).

As an alternative to applying the time-domain overlap-add process to a complete speech signal it may be applied to an excitation component, for example by using LPC analysis to produce a residual signal (or a parametric representation of it) and applying the overlap-add process to the residual prior to passing it through an LPC synthesis filter (see "Pitch-synchronous Waveform Processing Techniques for Text-to Speech Synthesis using Diphones", F. Charpentier and E. Moulines, European Conference on Speech Communications and Technology, Paris, 1989, vol. II, pp. 13–19).

The basic principle of the overlap-add process is shown in FIG. 1 where a speech signal S is shown with pitch marks P centered on the excitation peaks; it is separated into overlapping segments by multiplication by windowing waveforms W (only two of which are shown). The synthesized waveform is generated by adding the segments together with time shifting to raise or lower the pitch with a segment being respectively occasionally omitted or repeated.

BRIEF DESCRIPTION AND SUMMARY OF THE INVENTION

According to the present invention there is provided a speech synthesis apparatus including means controllable to vary the pitch of speech signals synthesized thereby, having:

(i) means for separating the speech signals into a spectral component and an excitation component;

(ii) means for multiplying the excitation component by a series of overlapping window functions synchronously, in the case of voiced speech, with pitch timing mark information corresponding at least approximately to instants of vocal excitation, to separate it into windowed speech segments;

(iii) means to apply a controllable time-shift to the segments and add them together; and (iv) means for recombining the spectral and excitation components wherein the multiplying means employs at least two windows per pitch period, each having a duration of less than one pitch period. Preferably the windows consist of first windows, one per pitch period, employing the timing mark portions and a plurality of intermediate windows, and the intermediate windows each have a width less than that of the first windows.

In another aspect, the invention provides a speech synthesis apparatus including means controllable to vary the pitch of speech signals synthesized thereby, having:

(i) means for separating the speech signals into a spectral component and an excitation component;

(ii) means for temporal compression/expansion of the excitation component, by interpolating new signal samples from input signal samples; and (iii) means for recombining the spectral and excitation components. Preferably the compression/expansion means is operable in response to timing mark information corresponding at least approximately to instants of vocal excitation to vary the degree of compression/expansion synchronously therewith such that the excitation signal is compressed/expanded less in the vicinity of the timing marks than it is in the center of the pitch period between two consecutive such marks.

BRIEF DESCRIPTION OF THE DRAWINGS

Some embodiments of the invention will now be described, by way of example, with reference to the accompanying drawings, in which.

DESCRIPTION OF THE PREFERRED EMBODIMENTS

Figure 2:
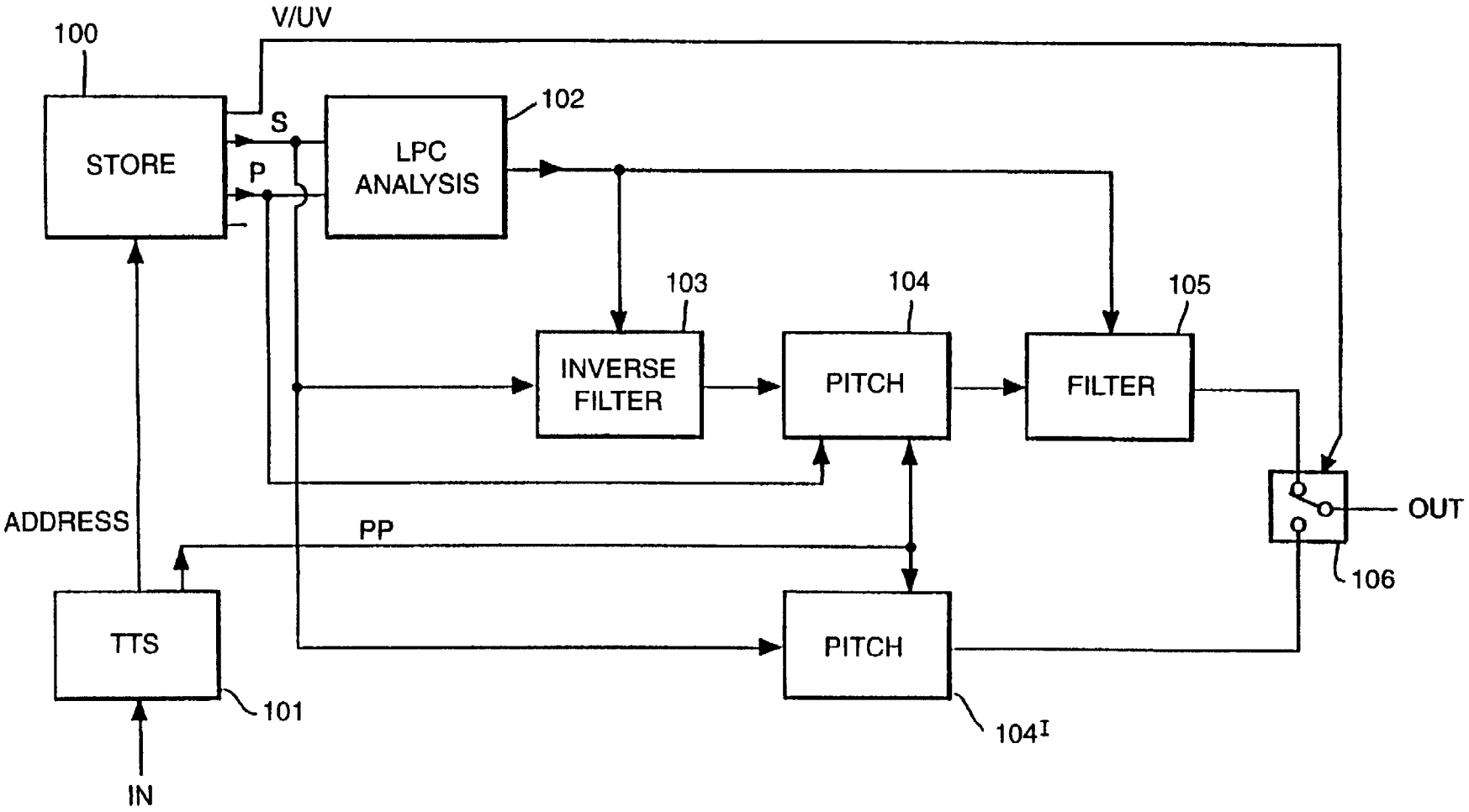
FIG. 2 is a block diagram of one form of synthesis apparatus according to the invention.

In the apparatus of FIG. 2, portions of digital speech waveform S are stored in a store 100, each with corresponding pitchmark timing information P, as explained earlier. Waveform portions are read out under control of a text-to-speech driver 101 which produces the necessary store addresses; the operation of the driver 101 is conventional and it will not be described further except to note that it also produces pitch information PP. The excitation and vocal tract components of a waveform portion read out from the store 100 are separated by an LPC analysis unit 102 which periodically produces the coefficients of a synthesis filter having a frequency response resembling the frequency spectrum of the speech waveform portion. This drives an analysis filter 103 which is the inverse of the synthesis filter and produces at its output a residual signal R.

The LPC analysis and inverse filtering operation is synchronous with the pitchmarks P, as will be described below.

Figure 1:
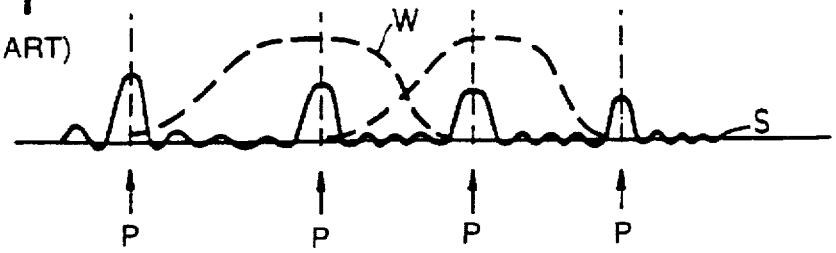
Fig. 1 (PRIOR ART)
FIG. 1 shows a speech signal with pitch marks centered on the excitation peaks and overlapping windows with reference to a prior art overlap-add process.
Figure 3:
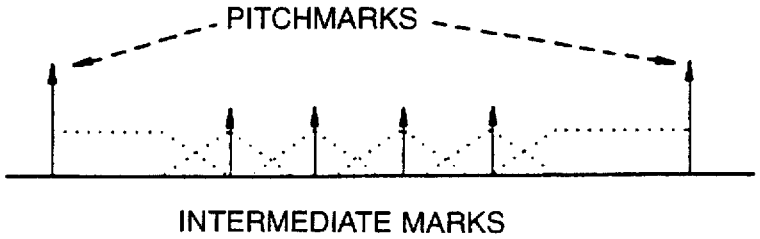
FIGS. 3, 3*a* and 5 are timing diagrams illustrating two methods of overlap-add pitch adjustment.

The next step in the process is that of modifying the pitch of the residual signal. This is (for voiced speech segments) performed by a multiple-window method in which the residual is separated into segments in a processing unit 104 by multiplying by a series of overlapping window functions, at least two per pitch period; five are shown in FIG. 3, which shows one trapezoidal window centered on the pitch period and four intermediate triangular windows. The pitch period windows are somewhat wider than the intermediate ones to avoid duplication of the main excitation when lowering the pitch.

Figure 3A:
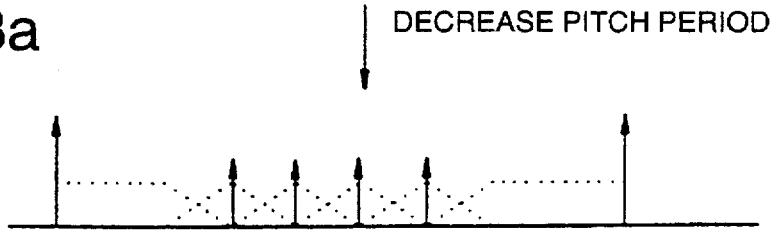

When raising the pitch, the windowed segments are added together, but with a reduced temporal spacing, as shown in FIG. 3*a*; if the pitch is lowered, the temporal spacing is increased. In either case, the relative window widths are chosen to give overlap of the sloping flanks (i.e. 50% overlap on the intermediate windows) during synthesis to ensure the correct signal amplitude. The temporal adjustment is controlled by the signals PP. Typical widths for the intermediate windows are 2 ms whilst the width of the windows located on the pitch marks will depend on the pitch period of the particular signal but is likely to be in the range 2 to 10 ms. The use of multiple windows is thought to reduce phase distortion compared with the use of one window per pitch period. After the temporal processing, the residual is passed to an LPC filter 105 to re-form the desired speech signal.

The store 100 also contains a voiced/unvoiced indicator for each waveform portion, and unvoiced portions are processed by a pitch unit 104' identical to the unit 104, but bypassing the LPC analysis and synthesis.

Switching between the two paths is controlled at 106.

Alternatively, the unvoiced portions could follow the same route as the voiced ones; in either case, arbitrary positions are taken for the pitch marks.

Figure 6:
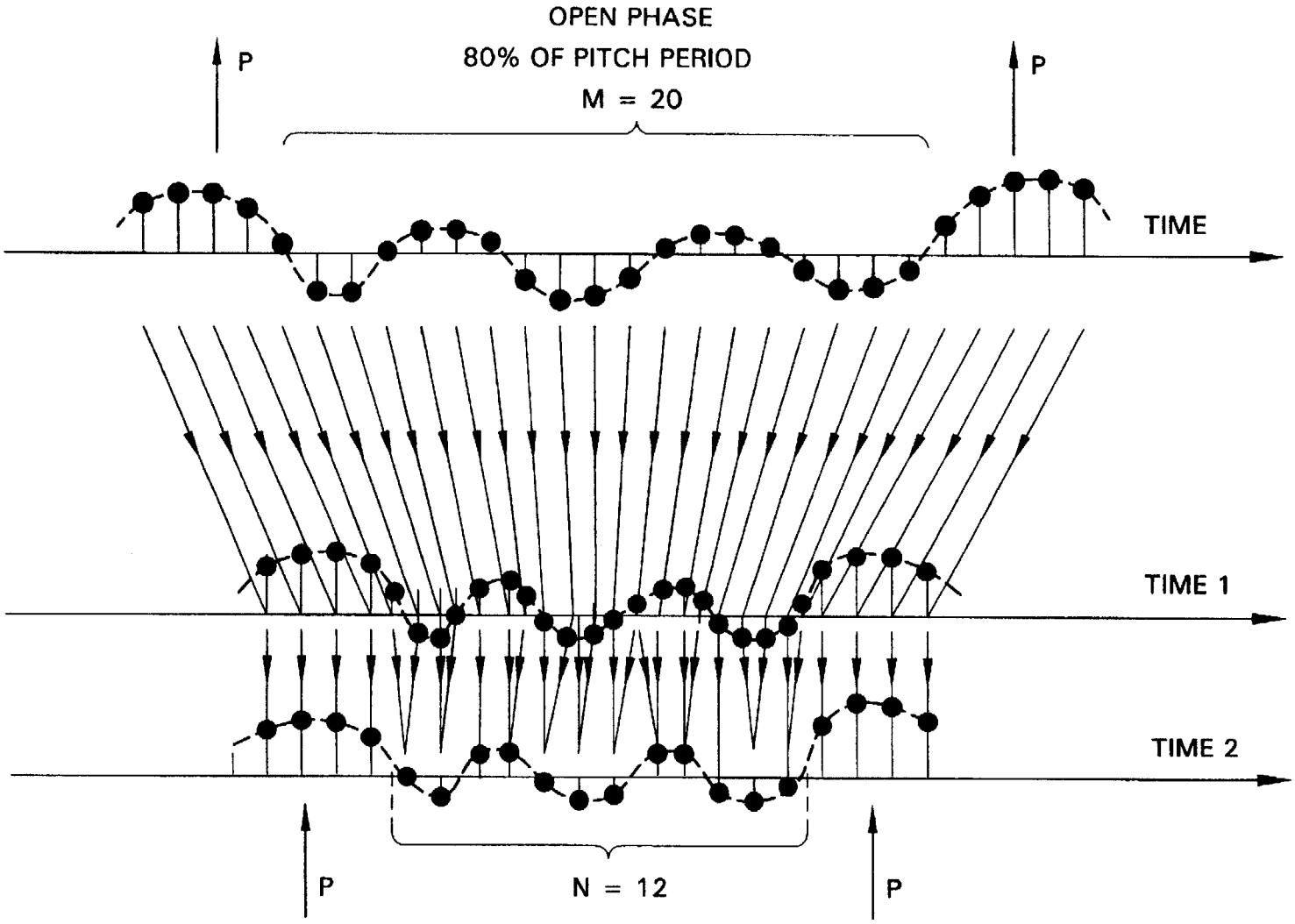
FIG. 6 shows a re-sampling of the open-phase process where M=20 samples are mapped to N=12 samples and the signal amplitude at the N samples being estimated by linear interpolation between the two nearest mapped samples.

As an alternative to overlap-add on the residual, another algorithm has been developed which aims to retain the shape of the residual, and further reduce phase distortion which may result from shifting and overlap-adding. The basic principle as illustrated in FIG. 6 is to alter the pitch period by resampling the open phase, (that is to say, a portion of the waveform between pitchmarks, leaving the significant information in the vicinity of the pitchmark unchanged) retaining the high frequencies injected at closure and giving a more realistic overall shape to the excitation period. Typically 80% of the period may be resampled.

Resampling is achieved by mapping each sample instant (M) at the original sampling rate to a new position on the time 1 axis. The signal amplitude at each sampling instant (N) for the resampled signal is then estimated by linear interpolation between the two nearest mapped samples Time 2. Linear interpolation is not ideal for resampling, but is simple to implement and should at least give an indication of how useful the technique could be. When downsampling to reduce the pitch period, the signal must be low-pass filtered to avoid aliasing. Initially, a separate filter has been designed for each pitch period using the window design method. Eventually, these could be generated by table lookup to reduce computation.

As a further refinement, the resampling factor varies smoothly over the segment to be processed to avoid a sharp change in signal characteristics at the boundaries. Without this, the effective sampling rate of the signal would undergo step changes. A sinusoidal function is used, and the degree of smoothing is controllable. The variable resampling is implemented in the mapping process according to the following equation:

$$T(n) = n\left(\frac{N-1}{M-1}\right) - \alpha\left(\frac{N-M}{M-1}\right)\cos\left[\frac{\pi(n-1}{M-3}\right], n = 1, \ldots, M-2$$

$T(0)=0$ $T(M-1)=N-1$ where

M=number of samples of original signal

N=number of samples of new signal $\alpha=[0,1]$ controls the degree of smoothing T(n)=position of the n'th sample of the resampled signal.

A major difference between this and single window overlap-add is that the change in pitch period is achieved without overlap-add of time-shifted segments, provided that the synthesis pitchmarks are mapped to consecutive analysis pitchmarks. If the pitchmarks are not consecutive, overlap-add is still required to give a smooth signal after resampling. This occurs when periods are duplicated or omitted to give the required duration.

An alternative implementation involves resampling of the whole signal rather than a selected part of each pitch period. This presents no problems for pitch raising provided that appropriate filtering is applied to prevent aliasing, since the harmonic structure still occupies the whole frequency range. When lowering pitch, however, interpolation leaves a gap at the high end of the spectrum. In a practical system aimed at telephony applications, this effect could be minimized by storing and processing the speech at a higher bandwidth than 4 kHz (6 kHz for example). The "lost" high frequencies would then be mostly out of the telephony band, and hence not relevant.

Both variations of the resampling technique suffer from the high computational requirements associated with interpolation/decimation, particularly if the resampling factor is not a ratio of two integers. The technique will become more attractive with continuing development of DSP technology.

Returning to the LPC analysis, as mentioned above, this is synchronous with the pitch markings. More particularly, one set of LPC parameters is required for each pitchmark in the speech signal. As part of the speech modification process, a mapping is performed between original and modified pitchmarks. The appropriate LPC parameters can then be selected for each modified pitchmark to resynthesize speech from the residual.

In LPC techniques, discontinuities can occur in the synthesized speech due to abrupt changes in the parameters at frame boundaries. This can result in clicks, pops, and a general rough quality, all of which are perceptually disturbing. To minimize these effects, LPC parameters are interpolated at the speech sampling rate in both analysis and synthesis phases.

The LPC analysis may be performed using any of the conventional methods, when using covariance or stabilized covariance method, each set of LPC parameters would be obtained for a section of the speech portion (analysis frame) of length equal to the pitch period (centered on the midpoint of the pitch period rather than on the pitch mark), or alternatively longer, overlapping sections might be used which has the advantage of permitting the use of an analysis frame of fixed length according to pitch.

Figure 4:
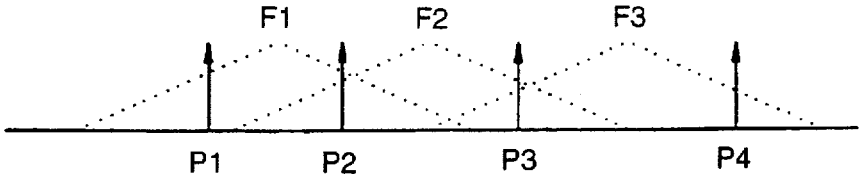
FIG. 4 is a timing diagram showing windowing of a speech signal for the purposes of spectral analysis.

Alternatively with an autocorrelation method, a windowed analysis frame is preferred, as shown in FIG. 4.

Although the frames in FIG. 4 are shown with a triangular window for clarity, the choice of window function actually depends on the analysis method used. For example, a Hanning window might be used. The frame center is aligned with the center of the pitch period, rather than the pitchmark. The purpose of this is to reduce the influence of glottal excitation on the LPC analysis without resorting to closed-phase analysis with short frames. As a result, each parameter set is referenced to the period center rather than the pitchmark. The frame length is fixed, as this was found to give more consistent results than a pitch-dependent value.

With short frame lengths, the stabilized covariance method would be preferable in terms of accuracy. With the longer frames used here, no perceptual difference is observed between the three methods, so the autocorrelation method is preferred as it is computationally efficient and guaranteed to give a stable synthesis filter.

Having determined the LPC parameters, the next step is to inverse filter the speech on a pitch-synchronous basis. As mentioned above, the parameters are interpolated to minimize transients due to large changes in parameter values at frame boundaries. At the center of each pitch period, the filter corresponds exactly to that obtained from the analysis. At each sampling instant between successive period centers, the filter is a weighted combination of the two filters obtained from the analysis. Preferably the interpolation is applied directly to the filter coefficients. This has been shown to produce less spectral distortion than other parameters (LAR's, LSP's etc), but is not guaranteed to give a stable interpolated filter. No instability problems have been encountered practice.

In general, at sample n the filter coefficients are given by $$a_n(i)=\alpha_n a_l(i)+(1-\alpha_n)a_r(i),\ i=0,\ldots,P$$

where p is the order of the LPC analysis, $\alpha_n$ is the value of a weighting function at sample n. $a_l$ and $a_r$ represent the parameter sets referenced to the nearest left and right period centers. To ensure a smooth evolution of filter coefficients, the weighting function is a raised half-cosine between successive period centers, given by $$\alpha(i)=0.5+0.5\cos(\pi i/N),\ i=0,\ N-1$$

where N is the distance between period centers, and i=0 corresponds to the center of each period.

The filter coefficients for the re-synthesis filter 105 are calculated in the same way as for inverse filtering. Modifications to pitch and durations mean that the sequence of filters and the period values will be different from those used in the analysis, but the interpolation still ensures a smooth variation in filter coefficients from sample-to-sample.

For the first pitchmark in a voiced segment, filtering starts at the pitchmark and no interpolation is applied until the period center is reached. For the last pitchmark in a voiced segment, the period is assumed to be the maximum allowed value for the purposes of positioning the analysis frame, and filtering stops at the pitchmark. These filtering conditions apply to both analysis and re-synthesis. When re-synthesizing from the first pitchmark, the filter memory is initialized from preceding signal samples.

Figure 5:
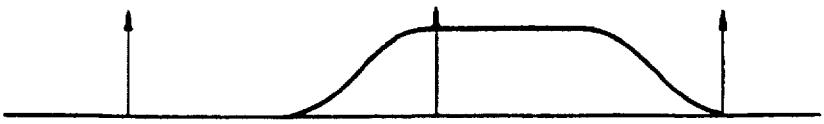

As a yet further alternative implementation of the pitch adjustment 104, a single-window overlap-add process may be used, with however a window width of less than two pitch period duration (preferably less than 1.7 e.g. in the range 1.25–1.6). With less than 100% overlap (i.e. 50% each side) the window function necessarily has a flat top, moreover it is preferably asymmetrically located relative to the pitch marks (preferably embracing a complete period between two pitchmarks). A typical window function is shown in FIG. 5, with a flat top having a length equal to the synthesis pitch period and flanks of raised half-cosine or linear shape.

With the window limited in duration as shown above, there is a potential problem when lowering pitch. When the synthesis pitchmarkers are sufficiently far apart, the windows will not overlap at all, and this situation will occur sooner with the shorter window than with standard pitch-synchronous overlap-add. The effect is to introduce a slight buzzy quality to the synthetic speech, but this only occurs when fairly extreme pitch lowering is requested by the TTS system. Pitch lowering is generally more difficult than pitch raising anyway, because of the need to generate missing data rather than cut out existing data. When raising pitch, the modified window produces better results due to the lower overlap period, and hence a shorter interval over which the signal is distorted.

This form of window is beneficial because a smaller temporal portion of the signal is constructed by the overlap-add process than with a longer window, and the asymmetric form places the overlap-add distortion towards the end of the pitch period where the speech energy is lower than immediately after the glottal excitation.

Use of the resampling and multi-window pitch control is envisaged (as shown in FIG. 2) as operating on the residual signal (to avoid distortion of the formants), however, the short asymmetric window method may also be employed without separation of the spectrum end excitation, but directly on the speech signal, in which case the analysis unit 102 and filters 103, 105 of FIG. 2 would be omitted, the speech signals from the store 100 being fed directly to the pitch units 104, 104'.

I claim:

1. A speech synthesis apparatus including means controllable to vary a pitch of speech signals synthesized thereby, having:

(i) means for separating the speech signals into a spectral component and an excitation component;

(ii) means for multiplying the excitation component by a series of overlapping window functions synchronous, in the case of voiced speech, with pitch timing mark information corresponding at least approximately to instants of vocal excitation, to separate it into windowed segments;

(iii) means to apply a controllable time-shift to the segments and add the time-shifted segments together; and (iv) means for recombining the spectral and excitation components;

wherein the multiplying means employs at least two windows per pitch period, each having a duration of less than one pitch period.

2. A speech synthesis apparatus according to claim 1 in which the windows consist of first windows, one per pitch period, embracing timing mark positions and a plurality of intermediate windows.

3. A speech synthesis apparatus according to claim 2 in which the intermediate windows each have a width less than that of the first windows.

4. A speech synthesis apparatus according to claim 3 comprising:

(a) a store containing items of data each defining a portion of speech signal waveform, and each including timing mark information corresponding at least approximately to a peak of the vocal excitation; and (b) driver means responsive to signals input thereto to provide addresses to read out items of data from the store and to provide pitch signals representing context-dependent pitch changes to be made to speech.

5. A speech synthesis apparatus according to claim 3 in which the means for separating the spectral and excitation components comprises:

(a) analysis means for receiving synthesized speech and generating parameters of a filter having a frequency response similar to the spectral content of the speech and of a filter having the inverse response; and (b) an inverse filter connected to receive the parameters to filter the speech to produce a residual signal;

and the means for recombining them comprises:

(c) a filter connected to receive the parameters and to filter the residual signal in accordance with the response.

6. A speech synthesis apparatus according to claim 2 comprising:

(a) a store containing items of data each defining a portion of speech signal waveform, and each including timing mark information corresponding at least approximately to a peak of the vocal excitation; and (b) driver means responsive to signals input thereto to provide addresses to read out items of data from the store and to provide pitch signals representing context-dependent pitch changes to be made to speech.

7. A speech synthesis apparatus according to claim 2 in which the means for separating the spectral and excitation components comprises:

(a) analysis means for receiving synthesized speech and generating parameters of a filter having a frequency response similar to the spectral content of the speech and of a filter having the inverse response; and (b) an inverse filter connected to receive the parameters to filter the speech to produce a residual signal;

and the means for recombining them comprises:

(c) a filter connected to receive the parameters and to filter the residual signal in accordance with the response.

8. A speech synthesis apparatus according to claim 1 comprising:

(a) a store containing items of data each defining a portion of speech signal waveform, and each including timing mark information corresponding at least approximately to a peak of the vocal excitation; and (b) driver means responsive to signals input thereto to provide addresses to read out items of data from the store and to provide pitch signals representing context-dependent pitch changes to be made to speech.

9. A speech synthesis apparatus according to claim 8 in which the means for separating the spectral and excitation components comprises:

(a) analysis means for receiving synthesized speech and generating parameters of a filter having a frequency response similar to the spectral content of the speech of and of a filter having the inverse response; and (b) an inverse filter connected to receive the parameters to filter the speech to produce a residual signal;

and means for recombining them comprises:

(c) a filter connected to receive the parameters and to filter the residual signal in accordance with the response.

10. A speech synthesis apparatus according to claim 1 in which the means for separating the spectral and excitation components comprises:

(a) analysis means for receiving synthesized speech and generating parameters of a filter having a frequency response similar to the spectral content of the speech and of a filter having an inverse response; and (b) an inverse filter connected to receive the parameters to filter the speech to produce a residual signal; and the means for recombining the spectral and excitation components comprises:

(c) a filter connected to receive the parameters and to filter the residual signal in accordance with the response.

11. A speech synthesis apparatus including means controllable to vary a pitch of speech signals synthesized thereby, having:

(i) means for separating the speech signals into a spectral component and an excitation component;

(ii) means for controlling pitch of the excitation component by repeating or omitting pitch periods thereof and, respectively, temporally compressing or expanding said component by interpolating new signal samples from input signal samples; and (iii) means for recombining the spectral and excitation components.

12. A speech synthesis apparatus according to claim 4 comprising:

(a) a store containing items of data each defining a portion of speech signal waveform, and each including timing mark information corresponding at least approximately to a peak of the vocal excitation; and (b) driver means responsive to signals input thereto to provide addresses to read out items of data from the store and to provide pitch signals representing context-dependent pitch changes to be made to speech.

13. A speech synthesis apparatus according to claim 11 in which the means for separating the spectral and excitation components comprises:

(a) analysis means for receiving synthesized speech and generating parameters of a filter having a frequency response similar to the spectral content of the speech and of a filter having the inverse response; and (b) an inverse filter connected to receive the parameters to filter the speech to produce a residual signal;

and the means for recombining them comprises:

(c) a filter connected to receive the parameters and to filter the residual signal in accordance with the response.

14. A speech synthesis apparatus according to claim 4, in which the compression or expansion means is operable in response to timing mark information including timing marks corresponding at least approximately to instants of vocal excitation to vary a degree of compression or expansion synchronously therewith such that the excitation signal is compressed or expanded less in the vicinity of the timing marks than it is in the center of a pitch period between two consecutive timing marks.

15. A speech synthesis apparatus according to claim 14 comprising:

(a) a store containing items of data each defining a portion of speech signal waveform, and each including timing mark information corresponding at least approximately to a peak of the vocal excitation; and (b) driver means responsive to signals input thereto to provide addresses to read out items of data from the store and to provide pitch signals representing context-dependent pitch changes to be made to speech.

16. A speech synthesis apparatus according to claim 4 in which the means for separating the spectral and excitation components comprises:

(a) analysis means for receiving synthesized speech and generating parameters of a filter having a frequency response similar to the spectral content of the speech and of a filter having the inverse response; and (b) an inverse filter connected to receive the parameters to filter the speech to produce a residual signal;

and the means for recombining them comprises:

(c) a filter connected to receive the parameters and to filter the residual signal in accordance with the response.

17. A speech synthesis apparatus including means for controlling a pitch of an input signal by multiplying the signal by a series of overlapping windows to separate it into segments and recombining the segments after subjecting the segments to a time shift, the windows being synchronous with timing marks representing instants of peak vocal excitation, wherein each window has a duration of less than twice a pitch period between timing marks and is asymmetric about the timing mark.

18. A speech synthesis apparatus according to claim 17 including means for separating a speech signal into a spectral component and an excitation component, the pitch controlling means being connected to receive the excitation component as said input signal, and means for recombining the spectral component and pitch-adjusted excitation component.

19. A speech synthesis apparatus according to claim 17 wherein each window has a duration of less than 1.7 times the pitch period between timing marks.

20. A speech synthesis apparatus according to claim 19 wherein each window has a duration of between 1.25 and 1.6 times the pitch period between timing marks.

21. A speech synthesis apparatus according to claim 17 wherein each window embraces a complete period between two pitchmarks.

* * * * *